US005401037A

United States Patent [19]

O'Donnell et al.

[11] Patent Number: 5,401,037

[45] Date of Patent: Mar. 28, 1995

[54] COMPOSITE WHEELS FOR IN-LINE ROLLER SKATES

[76] Inventors: Patrick J. O'Donnell, 6236 Hasbrook Ave., 2nd Fl., Philadelphia, Pa. 19111; Steven C. Preston, 54 Neillian Way, Bedford, Mass. 01730

[21] Appl. No.: 134,167

[22] Filed: Oct. 8, 1993

[51] Int. Cl.[6] ..... A63C 17/14; A63C 17/22

[52] U.S. Cl. ..... 280/11.2; 280/11.22; 301/5.3; 301/64.7

[58] Field of Search ..... 280/11.2, 11.22, 11.23; 301/5.3, 5.7, 64.7

[56] References Cited

U.S. PATENT DOCUMENTS

| | | | |
|---|---|---|---|
| 282,156 | 7/1883 | Burton | 280/11.23 |
| 320,774 | 6/1885 | Gardner | 301/5.3 |
| 321,873 | 7/1885 | Wicker | 301/5.3 |
| 1,687,113 | 10/1928 | Stockdale | 301/5.3 X |
| 4,699,432 | 10/1987 | Klamer | 301/5.3 |
| 5,028,058 | 7/1991 | Olson | 280/11.22 |
| 5,092,614 | 3/1992 | Malewicz | 280/11.22 |
| 5,129,709 | 7/1992 | Klamer | 301/5.3 |
| 5,312,165 | 5/1994 | Spletter | 280/11.22 X |

FOREIGN PATENT DOCUMENTS

| | | | |
|---|---|---|---|
| 1031192 | 5/1958 | Germany | 301/5.3 |
| 30102 | 12/1908 | United Kingdom | 301/5.3 |

*Primary Examiner*—Brian L. Johnson
*Attorney, Agent, or Firm*—Michael Ebert

[57] ABSTRACT

In-line roller skates whose wheels make it possible for a skater to stop without the need for a braking pad or other special expedients for this purpose. Each skate includes a boot to accommodate the skater's foot and a frame secured to the underside of the boot supporting a series of in-line wheels having a composite structure. Each composite wheel includes a center section formed of hard material, such as high-density polyethylene, having a low coefficient of friction, the center section being flanked by side sections formed of relatively soft material, such as cast polyurethane, having a high coefficient of friction. In order to stop or reduce speed, the skater turns the in-line skates away from the direction of travel as he would when braking ice skates. This maneuver causes a portion both of the hard and a soft section of the composite wheels, now angled with respect to the direction of travel, to frictionally engage the ground to effect a braking action.

8 Claims, 2 Drawing Sheets

COMPOSITE WHEELS FOR IN-LINE ROLLER SKATES

BACKGROUND OF INVENTION

1. Field of Invention:

This invention relates generally to in-line roller skates, and more particularly to composite wheels for such skates which make it possible to skate in control at any speed, yet to slow down and stop easily without the need for a brake pad or other special expedients for this purpose.

2. Status of Prior Art:

In-line roller skates are often referred to as ROLLERBLADE skates, this being the trademark for the best known brand of such skates. In a skate of this type, each foot of the skater is received in a boot having attached to its underside a frame supporting a set of wheels in tandem relation. In an in-line skate, the wheels are aligned in a single row rather than in parallel rows as in a conventional roller skate. The in-line wheels are so shaped and placed as to allow tilting of the skate as much as 30 degrees from the vertical without substantially reducing the ground contact area of the wheels.

Using standard in-line roller skates, a skilled skater can attain speeds exceeding 30 miles per hour on a flat pavement or other road surface, a far greater speed than is achievable with conventional roller skates. These high speed make it difficult and sometimes dangerous for the skater to quickly brake, particularly when faced with an unexpected obstacle requiring the skater to come to an abrupt halt to avoid a collision.

According to American Sports Data, in-line roller skating is the fastest growing sport in our nation. As more in-line skaters take to the road, skating-related injuries continue to rise. It is generally recognized that the key to safe in-line roller skating is effective stopping and speed control, and that most accidents occur because of the inability of the skater to brake without losing his balance.

In standard in-line roller skates, mounted at the rear of the right skate is a heel brake provided with a soft rubber pad. To effect stopping, the skater must shift most of his weight onto the non-braking left skate while upwardly tilting the toe of his right skate and pressing the heel brake against the road surface.

This braking maneuver is not easy to execute. As a consequence, inexperienced in-line roller skaters who have difficulty controlling their speed, usually lose their balance when trying to operate the heel brake. These novice skaters may then resort to a crash landing or spilling onto the grass or dirt on the side of the road. In either case, the skater may suffer broken wrists and arms, fractured shoulders or collar bones, or back and ankle sprains.

More experienced and skillful in-line roller skaters tend not to use the heel brake and in some instances, they actually detach the brake from the skate. What these skilled skaters do is to use the so-called T-stop maneuver in which the skater drags the wheels of one skate so that it is perpendicular to the other.

The T-stop braking maneuver can wear out a set of wheels in two or three months, depending on the roughness of the road surface. And skaters who brake downhill frequently, using the T-stop maneuver, will find themselves in the need of a new set of wheels in short order. Since a new set of wheels currently costs about 50 dollars, the T-stop maneuver is one few skaters can afford.

The 1993 patent to Landers, U.S. Pat. No. 5,207,438, calls attention to the drawbacks of existing in-line roller skates having a rear braking pad. As noted in this patent, the brake pad requires the skater to execute an awkward, out-of-balance foot maneuver. Lander's solution to this problem resides in a braking system positioned in the toe portion of the boot. This system includes a rotatable cylinder placed between a pair of brackets, the cylinder rotating in contact with the brackets to produce a frictional force when the cylinder makes contact with the ground.

The 1993 patent to Roberts, U.S. Pat. No. 5,197,572, provides at the rear of an in-line roller skate, a cast brake shoe on which a replaceable rubber pad is mounted. Roberts points out that in-line skaters sometimes resort to the same type of action as ice skaters do in stopping forward motion. The same point is made in the 1993 patent to Dettmer, U.S. Pat. No. 5,171,032, who further notes that side slipping, i.e., where ice skates are pointed perpendicularly to the skates direction of movement, would wear flat spots on in-line roller skate wheels which are then rendered unusable.

Thus while Dettmer considers the possibility of using in-line skate wheels to effect braking in the manner of ice skates, he dismisses thins maneuver as causing unacceptable wheel wear. Instead he provided brake pads in the spaces between the wheel and a cable connected to a hand-held lever to actuate the pads.

The 1992 patent to Allison, U.S. Pat. No. 5,135,244, discloses an in-line roller skate having a leaf spring adapted to frictionally engage a forward or rear, wheel to impede wheel rotation. The 1993 patent to Hoskin, U.S. Pat. No. 5,183,275, discloses an articulated mounting on an in-line roller skate frame that movably mounts a roller for selective engagement with the rear wheel of the skate and a ground-engaging brake pad arrangement that serves to actuate the mounting to move the roller into contact with the roller skate wheel and apply a braking force thereto as well as to the skate itself.

Also of background interest is the 1991 patent to Olson U.S. Pat. No. 5,028,058 (assigned to Rollerblade, Inc.) which makes reference to a 1966 patent U.S. Pat. No. 3,287,023 to Ware disclosing an in-line skate with thin, rounded wheels adapted to simulate the performance of ice skates. The Ware skate makes use of a wheel formed of firm but slightly soft and resilient rubber, and a toe brake at the front end of the skate to effect stopping.

SUMMARY OF INVENTION

In view of the foregoing, the main object of this invention is to provide in-line roller skates having wheels which make it possible to stop or reduce speed without the need for a braking pad or other special expedients for this purpose.

More particularly, an object of the invention is to provide in-line roller skates that include composite wheels a portion of which is formed by a hard material having a high slip surface, the remaining portion being formed by a relatively soft material having a grabbing surface whereby the skater is able to stop or control his speed using braking maneuvers similar to those executed by ice skaters without however damaging the wheels.

A significant advantage of the invention is that it takes little training to learn to brake with these in-line roller skates; hence novice skaters are able to stop or reduce speed without losing their balance.

Also an object of the invention is to provide composite wheels for in-line roller skates having a prolonged operating life that can be mass-produced at relatively low cost.

Briefly stated, these objects are attained by in-line roller skates whose wheels make it possible for a skater to stop without the need for a braking pad or other special expedients for this purpose. Each skate includes a boot to accommodate the skater's foot and a frame secured to the underside of the boot supporting a series of in-line wheels having a composite structure.

In a preferred embodiment each composite wheel includes a center section formed of a hard material such as high-density polyethylene having a low coefficient of friction, the center section being flanked by side sections formed of relatively soft material, such as cast polyurethane, having a high coefficient of friction. In order to stop, or reduce speed the skater turns the in-line skates away from the direction of travel as he would when braking ice skates. The hard center of the composite wheel allows the wheel to slip over the riding surface in contrast to a polyurethane wheel which under normal circumstances would not allow any slippage. This maneuver causes a portion of both the hard and soft section of the composite wheels, now angled with respect to the direction of travel, to frictionally engage the ground to effect a braking action.

The skater can gradually increase or decrease the braking action by allowing more or less of the elastomer to contact the ground. The greater the angle of declination, the higher the frictional resistance, hence the more abrupt the stop. This is analogous to braking in ice skating and is desirable because it is an inherently stable situation.

BRIEF DESCRIPTION OF DRAWING

For a better understanding of the invention, as well as other objects and features thereof, reference is made to the detailed description thereof to be read in conjunction with the annexed drawing wherein.

DETAILED DESCRIPTION OF INVENTION

Basic Principles

Figure 1:
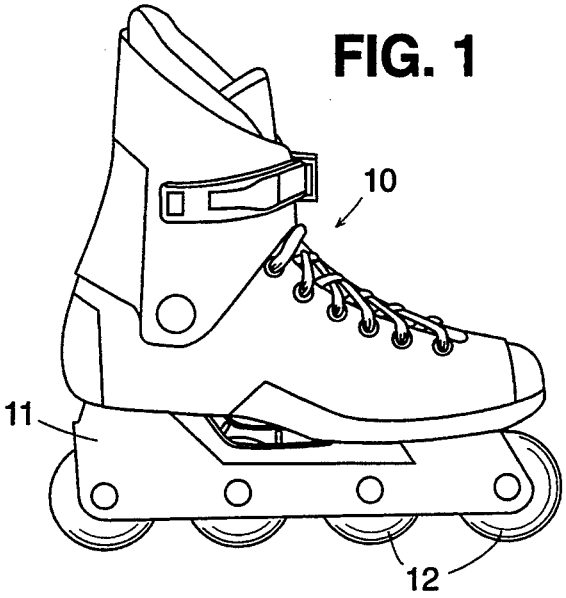
FIG. 1 illustrates in perspective an in-line roller skate having composite wheels in accordance with the invention.
Figure 2:
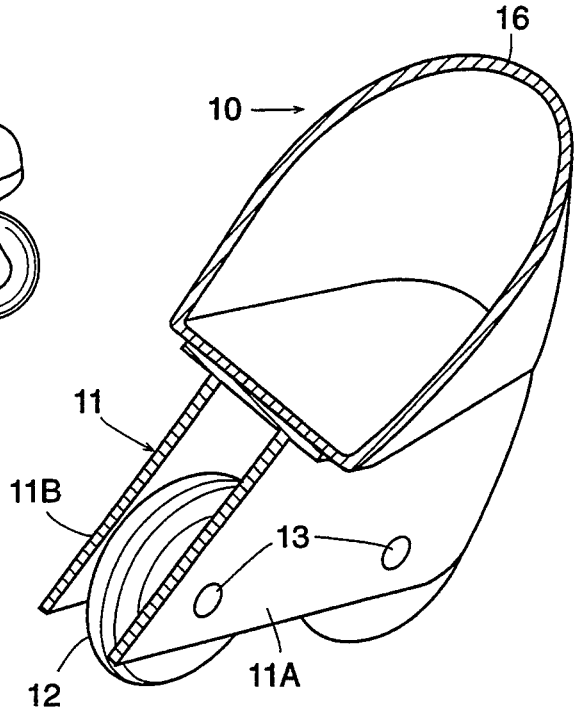
FIG. 2 is a cut-away view of the heel portion of the skate.

In an in-line roller skate in accordance with the invention, as shown in FIGS. 1 and 2, a boot 10 is provided to accommodate a foot of the skater. Attached to the underside of the boot is a frame 11 having a pair of side rails 11A and 11B for supporting a set of three or more rotatable wheels 12 in tandem relation, each wheel having a hub, adapted to receive a wheel axle 13 which bridges rails 11A and 11B.

The wheels 12 in the set have a composite structure which makes it possible to brake the in-line skates in a manner similar to that by which ice skates are braked. With ice skates one is able to turn the shoes or boots away from the direction of travel, thereby increasing resistance to forward motion and reducing speed. The most commonly used stopping maneuvers with ice skates are the so called "snow plow" maneuver and the "hockey stop" maneuver.

In the "snow plow" maneuver which is the maneuver a beginner ice skater is first taught, the toe ends of the ice skates are progressively angled to point toward each other while the body weight is kept forward over the skates. As a consequence of this posture, the ice skates will scrape along ice with increasing friction as more blade area is presented against the direction of travel.

The "hockey stop" maneuver which is more difficult to execute, is performed by leaning back and putting both skates almost perpendicular to the direction of travel. The resultant stopping action is more or less abrupt, depending on how far back the skater is leaning, how fast the skates are traveling and how much of the blade surface is in contact with the ice.

In-line roller skates having conventional polyurethane wheels cannot perform in the manner of ice skates. Because these wheels which have a diameter of about 70 mm, are somewhat soft, they exhibit a relatively high coefficient of friction and grip therefore the pavement or other road surface on which the wheels ride. As a consequence, the in-line roller skater is not easily able to point the skates in any direction other than straight ahead.

With ice skates, the hockey stop is effected by turning the ice skates roughly perpendicular to the direction of forward motion, leaning backward and quickly skidding to a stop. But this maneuver cannot be safely performed with conventional in-line roller skates, for upon hitting the ground, movement would immediately be arrested, and the skater would lose control.

With in-line roller skates having composite wheels in accordance with the invention, the skater is able to come to a stop gracefully and without difficulty by executing maneuvers similar to these performed with ice skates. The composite structure of the wheels is constituted by a portion of hard material presenting a slippery surface having a low coefficient of friction, and a portion of relatively soft material presenting a grabby surface having a high coefficient of friction.

The distribution of the hard and soft materials in the composite wheel is such that enough hard material is in contact with the road to permit the skater to turn the skates away from the direction of forward travel gradually and thereby regulate the speed of travel. The soft material makes it possible, when the skates are turned, to grab the road and generate sufficient friction to effect braking in a gradual and controllable manner.

Among the materials which are suitable for forming the hard portion of a composite wheel in accordance with the invention are hard polyurethane, KEVLAR, hard silicones, hard rubbers, metals and ceramics. A preferred hard material is UHMW (ultra-high molecular weight) polyethylene, for this material has exceptional structural strength and abrasion resistance coupled with a low coefficient of friction approaching that of TEFLON.

Among the materials which are suitable for forming the soft portion of the composite wheel are soft cast and thermoplastic polyurethanes, soft silicones, soft rubbers, as well as soft elastomers.

Operation of The Composite Wheels

Friction is the force which resists the movement of one body over another. If one body surface slides or rubs over the other and the surfaces are pressed together by a force N normal thereto, then a frictional force F must be overcome for movement to take place.

This frictional force is commonly expressed as $F=\mu N$, where $\mu$ is the coefficient of friction which is the ratio between the normal force N pressing the surfaces together and the frictional force F required to move one surface over the other. This ratio is fairly constant, depending only on the nature of the bodies in contact with each other.

This coefficient of friction is normally considered to have two values, depending on the relative velocity of the two bodies in contact with each other. The static coefficient of friction $\mu_{static}$ represents the maximum frictional force produced when the relative velocity is zero. The kinetic coefficient of friction $\mu_{kinetic}$ represents the frictional force when the relative velocity is not zero. This is usually approximated by a single value, although there may be a velocity dependence. In an in-line roller skate in accordance with the invention, the composite wheels have a portion formed of hard, low-coefficient of friction material and a portion formed of relatively soft, high-coefficient of friction material.

When the skate is traveling in the forward direction, the in-line composite wheels which engage the road surface only encounter rolling friction and the rolling wheels then afford sufficient traction to resist slipping at the points of contact between the wheels and the road surface. But when these wheels are angled by the skater with respect to the direction of forward motion, then the wheels slide along the road surface and since it is then mainly the soft portion of the wheels which engage the surface, the resultant high degree of sliding friction resists this sliding motion to brake the skate.

Hence no need exists for a separate brake pad or other expedient to effect stopping.

Composite Wheel Embodiments

Figure 3:
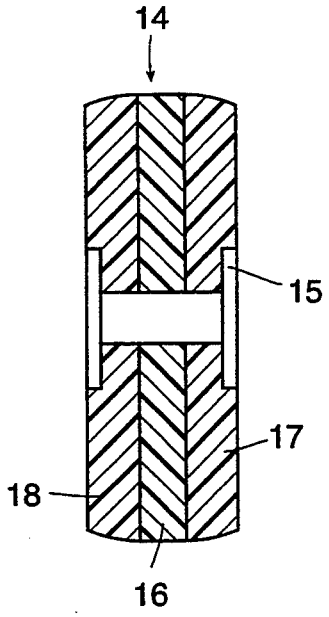
FIG. 3 is a section taken through a first preferred embodiment of a composite wheel in accordance with the invention.
Figure 4:
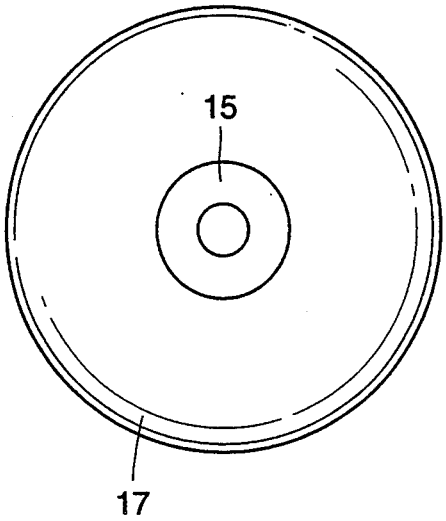
FIG. 4 is a side view of this wheel.

A first embodiment of a composite wheel is shown in FIGS. 3 and 4. The composite wheel, generally identified by numeral 14, is provided at its axis of rotation with a hub 15 for accommodating an axle. Mounted on hub 15 is a center section 16 of hard material, this section being flanked on either side by side sections 17 and 18 of soft material where outer edges are rounded.

As used herein, "hard" material always refers to a material having a low coefficient of friction and "soft" material to one having a relatively high coefficient of friction.

In skating on the composite wheel, one normally rides on the hard center section 16 of the wheel when traveling in the forward direction. But when one leans over to stop or turn, a combination of the soft material of the side section 17 or 18 and the hard material 16 then engages the road to provide greater friction and/or stopping power.

The high-coefficient of friction of the side edges of the wheel are analogous to the edge of an ice skate blade, while the hard center section of the wheel corresponds to the flat portion of the! blade which engages the surface of the ice when skating in,the forward direction.

Figure 5:
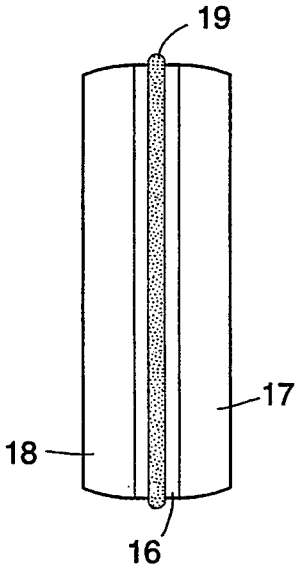
FIG. 5 is an end view of a second preferred embodiment of the composite wheel.

To provide a smoother roll and better push off, in the modified form of composite wheel shown in FIG. 5, the hard center section 16 of the wheel is provided at its middle with a circumferential strip 19 of soft material.

Figure 6:
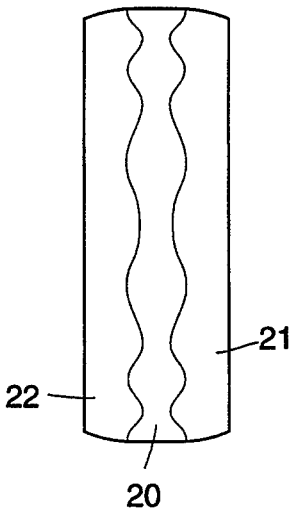
FIG. 6 is an end view of a third preferred embodiment.

In the embodiment of a composite wheel shown in FIG. 6, instead of a composite structure as shown in FIG. 3 in which there is an abrupt linear transition from the hard section to the soft section of the wheel, the composite wheel may have a hard center section 20 having a wavy interface with the soft side sections 21 and 22 which flank the center section. This helps to compensate for the normal force N, i.e., the weight of the skater.

Figure 7:
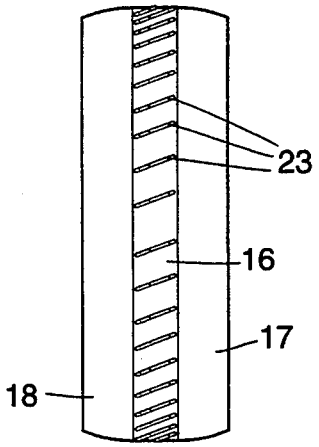
FIG. 7 is an end view of a fourth preferred embodiment.
Figure 8:
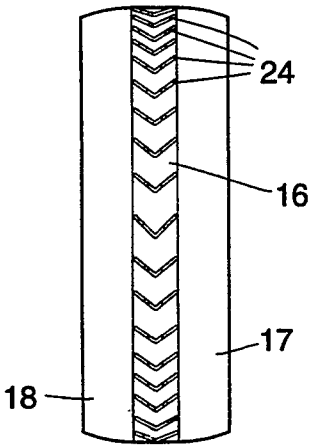
FIG. 8 is an end view of a fifth preferred embodiment.

In the embodiment of the composite wheel shown in FIG. 7 which includes a hard center section 16 flanked by soft side sections 17 and 18 as in the FIG. 3 wheel, the center section 16 is provided with a circumferential array of soft angled stripes 23, these stripes serving to enhance the rolling characteristics of the wheel. In the embodiment of the wheel shown in FIG. 8, the center section of the wheel is provided with a circumferential array of chevron-shaped soft stripes 24.

Figure 9:
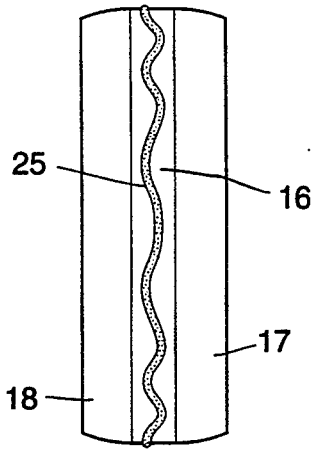
FIG. 9 is an end view of a sixth preferred embodiment.

Instead of stripes of soft material, one may provide, as shown in FIG. 9, at the middle of the hard center section a sinuous ring 25 of soft material.

In general, the distribution of hard and soft materials in a composite wheel in accordance with the invention is such that the durometer of the wheels must become harder as one goes from the outer edges of the wheel toward the center thereof. However, the curve representing durometer of the wheel hardness may have its peak at the center of the wheel, or the hardness peak may have at its center a soft trough representing soft material. The distribution of hard and soft materials must take into account that when the wheel rides over a road surface in the forward direction, it is mainly the center portion of the wheel that engages this surface, the side portion coming into play mainly when the wheel is turned to deviate from the forward direction.

Figure 10:
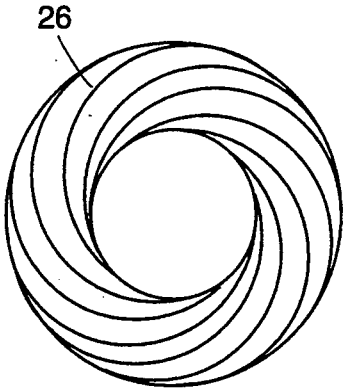
FIG. 10 is a side view of the center "hard" section of a seventh preferred embodiment of a composite wheel in accordance with the invention.

Radial rigidity determines the deformability or "bounce" of the wheel, the greater the rigidity, the lesser the ride comfort. While the hard material in the central region of the wheel is inherently rigid, it need not be shaped so that it transfers most of its load radially inward. As shown in FIG. 10, the hard center section 26 of the composite wheel may be created by a series of spiral spokes so arranged that the inner end of each spoke is angularly, displaced from the outer end to a degree significantly reducing the radial rigidity of this center section which is flanked by soft sections of soft urethane or other material having a high coefficient of friction.

While there have been shown preferred embodiments of the invention, it is to be understood that many changes and modifications may be made therein without departing from the essential spirit of the invention.

Thus in practice only some of the wheels in the set of in-line wheels may be composite wheels.

We claim:

1. An in-line roller skate capable of riding at high speed on a skating surface and of being braked by a skater by a maneuver in which the skate is angled with respect to a direction of forward motion, said roller skate comprising:

A. a boot for accommodating a foot of the skater;

B. a frame secured to the boot; and

C. a set of wheels supported for rotation in tandem relation on said frame; the wheels in the set having a composite structure including a central portion providing means for sliding formed of a material exhibiting a very low coefficient of sliding friction having a slippery surface flanked by side portions providing means for bracing formed of a material exhibiting a relatively high coefficient of sliding friction, the relative values of sliding friction being such that when the skate travels in the forward direction, the wheels then roll on this surface, and when the skate is angled with respect to the forward direction to effect a stopping action, this maneuver causes the wheels to slide on their central portion on the skating surface, the side portion of the wheels then acting to frictionally engage the skating surface to slow down the slide to effect a braking action.

2. A roller skate as set forth in claim 1 in which the frame includes a pair of parallel side rails, each wheel being mounted on an axle bridging the side rails.

3. A skate as set forth in claim 1, in which said material exhibiting a very-low coefficient of sliding friction is chosen from a class consisting of UHMW polyethylene, hard polyurethane, ceramics, hard silicones and hard rubbers.

4. A skate as set forth in claim 1, in which said material exhibiting a relatively high coefficient of sliding friction is chosen from a class consisting of soft polyurethane, soft silicone and soft rubber.

5. A skate as set forth in claim 1, having a circumferential array of stripes of material of relatively high coefficient of sliding friction formed on the surface of the central portion.

6. A skate as set forth in claim 5, whereon said stripes have a chevron form.

7. A skate as set forth in claim 1, wherein an interface between the central portion and said side portions is wavy.

8. A composite wheel for an in-line roller skate comprising:

A. a central portion providing means for sliding formed of a material exhibiting a very low coefficient of sliding friction that renders the central portion slippery on a road surface; and B. side portions flanking the central portion providing means for braking formed of a material exhibiting a relatively high coefficient of sliding friction to impart traction to the side portions, the relative values of sliding friction being such that when the skate travels in a direction of forward motion on a skating surface, the composite wheel then rolls on the skating surface, and when the skate is angled with respect to the direction of forward motion, the composite wheel then slides on its central portion and said side portions frictionally engaging the skating surface to slow down the slide to effect a braking action.

* * * * *

UNITED STATES PATENT AND TRADEMARK OFFICE

CERTIFICATE OF CORRECTION

PATENT NO. : 5,401,037

DATED : March 28, 1995

INVENTOR(S) : O'Donnell, et al.

It is certified that error appears in the above-identified patent and that said Letters Patent is hereby corrected as shown below:

Column 7, claim 1, line 17, delete 'bracing" and substitute --braking--.

Signed and Sealed this

Tenth Day of October, 1995

*Attest:*

Bruce Lehman

BRUCE LEHMAN

*Attesting Officer*

*Commissioner of Patents and Trademarks*